US006620087B1

(12) United States Patent
Plourde

(10) Patent No.: US 6,620,087 B1
(45) Date of Patent: Sep. 16, 2003

(54) ZIPPER SEGMENT FOR TRANSVERSE DIRECTION APPLICATION TO A BAG FILM

(75) Inventor: Eric P. Plourde, Tinley Park, IL (US)

(73) Assignee: Illinois Tool Works Inc., Glenview, IL (US)

( * ) Notice: Subject to any disclaimer, the term of this patent is extended or adjusted under 35 U.S.C. 154(b) by 87 days.

(21) Appl. No.: 09/656,279

(22) Filed: Sep. 6, 2000

(51) Int. Cl.[7] ..... B31B 1/84

(52) U.S. Cl. ..... 493/213; 493/212; 493/214; 493/927; 53/13.4; 53/139.2

(58) Field of Search ..... 493/212, 213, 493/214, 927; 53/133.4, 139.2; 428/223, 121–124, 130, 192; 24/30.5 R–30.5 L

(56) References Cited

U.S. PATENT DOCUMENTS 4,094,729 A * 6/1978 Boccia ..... 493/214
4,691,373 A * 9/1987 Ausnit ..... 383/63
4,909,017 A * 3/1990 McMahon et al. ..... 53/410
5,024,537 A * 6/1991 Tilman ..... 24/403
5,071,689 A * 12/1991 Tilman ..... 428/121
5,461,845 A * 10/1995 Yeager ..... 53/451
5,776,045 A 7/1998 Bodolay et al.
6,017,412 A * 1/2000 Van Erden et al. ..... 156/290
6,099,451 A * 8/2000 Mulder et al. ..... 493/214

FOREIGN PATENT DOCUMENTS

EP 0 970 804 A2 1/2000

* cited by examiner

*Primary Examiner*—Rinaldi I. Rada
*Assistant Examiner*—Thanh Truong
(74) *Attorney, Agent, or Firm*—Pitney, Hardin, Kipp & Szuch LLP

(57) ABSTRACT

A zipper segment for transverse direction application to a bag film web in which the profiles are of unequal lengths and joined together at their ends. As a result, the shorter profile is placed in tension. During bag formation the longer profile is initially attached to the bag film web and the shorter side is attached only by the engagement of the profile interlocking members and end seals. The shorter side, which is not directly attached to the web, nonetheless remains close to the web as a result of the tension imparted on the short side by the longer side.

5 Claims, 3 Drawing Sheets

ZIPPER SEGMENT FOR TRANSVERSE DIRECTION APPLICATION TO A BAG FILM

BACKGROUND OF THE INVENTION

Field of the Invention

In U.S. Pat. No. 4,909,017 a method is disclosed for forming reclosable plastic bags wherein the zipper is disposed transverse with respect to the running direction of the web of bag film. One of the zipper profiles is attached to the bag web prior to the web being transformed into a bag tube while the other profile is connected to the bag web, at this point, only by the engagement of the interlocking elements of the profiles. This may be augmented by sealing the ends of the profile sections to each other. It is not until after the bag web is transformed into a tube that both of the profiles are sealed to the bag web.

A problem that is encountered with such transverse direction bag forming equipment is that as the web of bag film with attached transverse direction zipper segments passes over the forming collar (to begin its transformation from a flat sheet to a tube), the unattached profile tends to lift away from the attached profile. In the worst case, the profiles can become misaligned or separated thereby preventing a proper zipper bag from being formed.

SUMMARY OF THE INVENTION

It is the principle object of the present invention to provide a method for maintaining the zipper profiles, including the un-attached profile, on the bag film web as the web feeds to and through associated transverse direction bag making equipment.

A further object is to provide such a method without requiring any substantial additional equipment.

A still further object is to provide such a method which is readily adaptable to the numerous types of transverse direction zipper bag forming equipment that are now commercially available.

The above and other beneficial objects and advantages are attained in accordance with the present invention by providing a zipper segment for transverse direction application to a bag film web in which the profiles are of unequal lengths and joined together at their ends. As a result, the shorter profile is placed in tension. During bag formation the longer profile is initially attached to the bag film web and the shorter side is attached only by the engagement of the profile interlocking members and end seals. The shorter side, which is not directly attached to the web, nonetheless remains close to the web as a result of the tension imparted on the short side by the longer side.

DETAILED DESCRIPTION OF THE DRAWINGS

Figure 1:
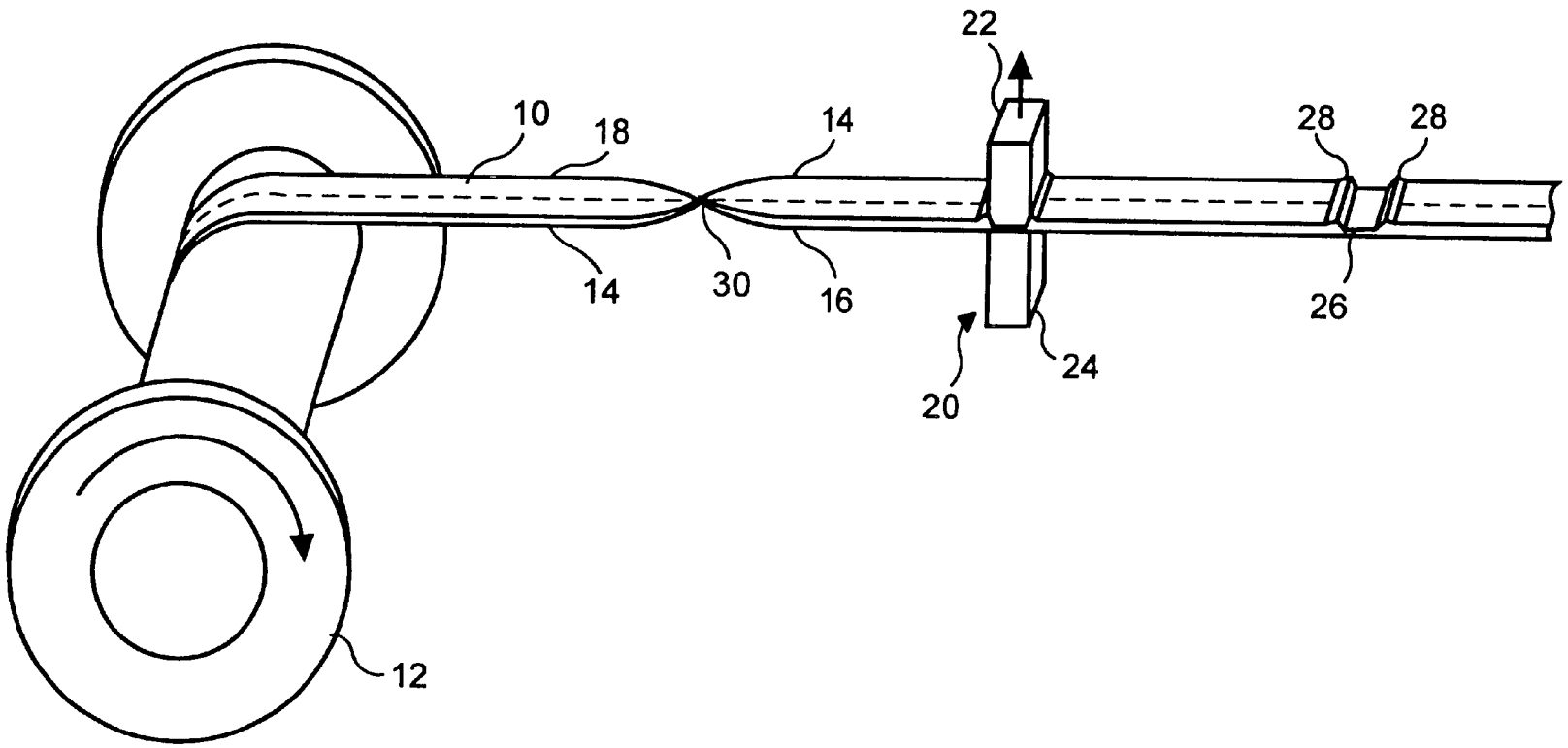
FIG. 1 is a perspective view of swaging equipment used to form zipper segments having profiles of unequal lengths.
Figure 2:
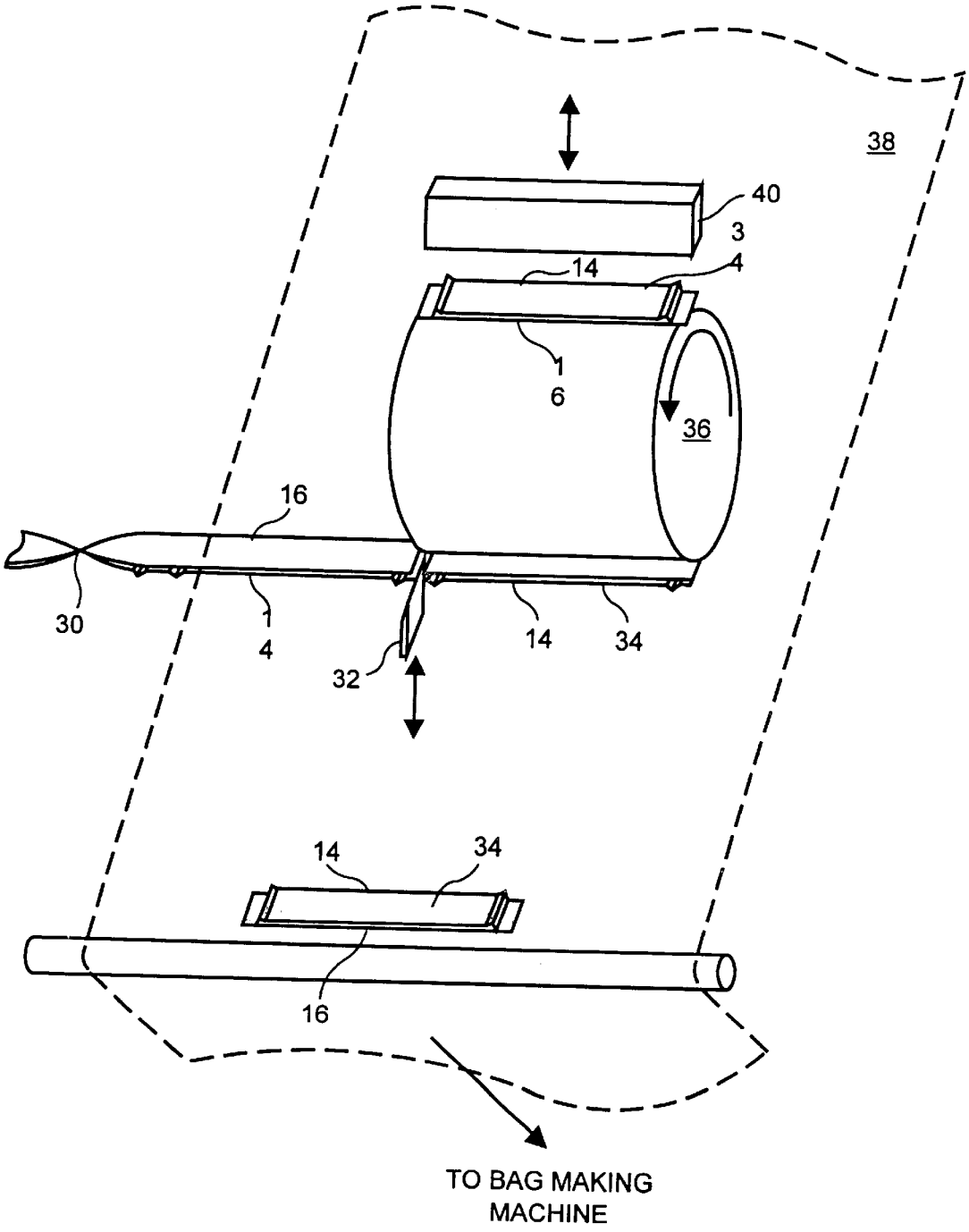
FIG. 2 is a perspective view of equipment used to attach zipper segments to a web of bag film; and, FIG. 3 is a side elevational view of the equipment of FIG. 2.
Figure 3:
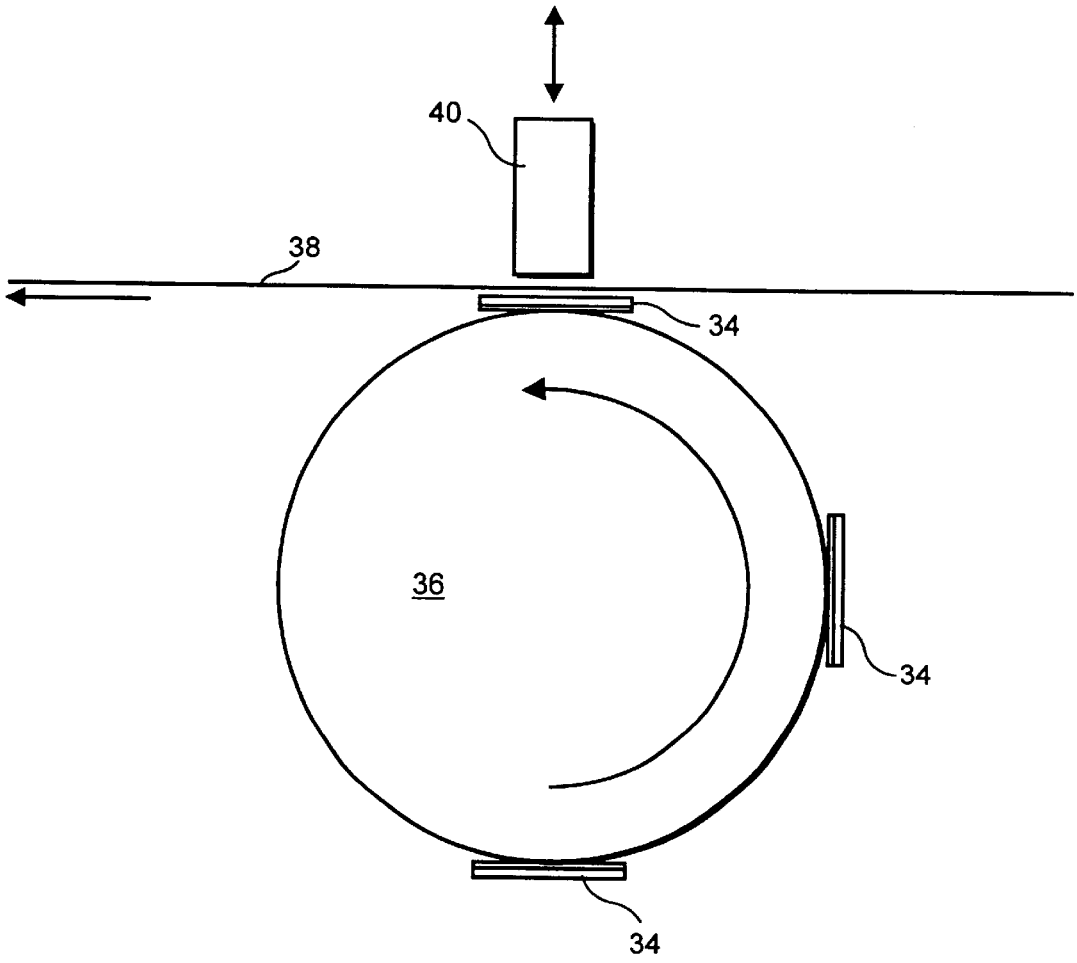

In FIG. 1 a zipper 10 is played off spool 12. The zipper 10 consists of two profiles 14, 16 containing interlocked engagement elements (not shown), which may be of any configuration but usually comprise a male shape and a complementary female shape. As zipper 10 plays off spool 12 it is twisted and then fed to a sealing apparatus 20 which consists of a heated bar 22 and an unheated platen 24. The heated bar 22 periodically comes down on the platen capturing a length of zipper therebetween, fusing the profiles 14, 16 together in the seal area 26. The action of the heated bar 22 causes a swaging of the profile 14 that it encounters, thereby lengthening that profile with respect to the mating profile 16 that rides on the unheated platen 24 and increasing the tension of profile 16. The increased length of the segment of profile 14 between adjacent seals 26 is reflected in crimps 28 at the ends of each seal area 26.

The zipper is then untwisted at 30 and brought under the bag film web 38 to knife 32 which bisects each seal 26 thereby freeing segments 34 from the zipper supply. The detached segments 34 are picked up by a vacuum drum 36 and deposited at spaced intervals under bag film web 38. It should be noted that the longer profile 14 is deposited in contact with the film and then sealed to the bag web 38 by sealing bar 40. The sealing operation is such as to seal only the longer profile 14 to the film web. This may be accomplished by conventional sealing techniques such as placing a non-seal coating on facing surfaces of the profiles 14, 16, by extending the flange of profile 14 to extend beyond that of profile 16 so that only the extended flange is engaged by the sealing bar, by controlling the heat of seal bar 40 or by any other conventional method. The web with the attached zipper segment is then fed to conventional TD bag making equipment for conversion into a bag.

Having thus described the invention, what is claimed is:

1. A method of making a web of bag making film comprising the steps of:

forming a zipper segment having profiles with interlocking elements, said profiles extending along a longitudinal axis with one of said profiles being longer along said longitudinal axis than the other of said profiles with the length of said profiles in a direction transverse to a running direction of said film;

joining the ends of said profiles so as to impart tension on the shorter one of said profiles by the longer one of said profiles; and sealing said longer profile to said film transversely to the running direction of said film.

2. The method in accordance with claim 1 wherein said zipper segment is formed by passing a continuous zipper between a seal bar and an anvil to seal said profiles to one another, with one of said profiles contacting the seal bar and the other of said profiles contacting the anvil, said seal bar being heated for sealing one of said profiles with respect to the other of said profiles, the other of said profiles contacting said anvil in which said anvil is not heated.

3. The method in accordance with claim 2 wherein said seal bar swages the profile in contact with it whereby to lengthen that profile with respect to the other profile.

4. The method in accordance with claim 3 comprising the further step of severing said continuous zipper through adjacent sealing sections to form said segment.

5. A web of bag making material comprising:

a bag making film and a segment of zipper attached to said film transverse to a running direction of said web, said zipper segment including a first profile seated to said film and a second profile having an interlocking element engaged with a complementary interlocking element of said first profile and said profiles extending along a longitudinal axis, wherein said first profile is longer along said longitudinal axis than said second profile with the length of said profiles in a direction transverse to the running direction of said web and the ends of said profiles are joined to one another whereby to impart tension on said second profile by said fist profile.

* * * * *